US006383621B1

(12) United States Patent
Tojima et al.

(10) Patent No.: US 6,383,621 B1
(45) Date of Patent: May 7, 2002

(54) THERMAL TRANSFER IMAGE FORMING MATERIAL

(75) Inventors: Shizuka Tojima; Katsumi Maejima, both of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/448,434

(22) Filed: Nov. 24, 1999

(30) Foreign Application Priority Data

Nov. 26, 1998 (JP) ..... 10-335761

(51) Int. Cl.[7] ..... B41M 5/26
(52) U.S. Cl. ..... 428/213; 428/195; 428/323
(58) Field of Search ..... 428/195, 206, 428/207, 213, 323, 327, 914

(56) References Cited

U.S. PATENT DOCUMENTS 5,328,800 A * 7/1994 Yokoya et al. ..... 430/203
5,427,840 A 6/1995 Imamura et al.
5,512,931 A * 4/1996 Nakajima et al. ..... 347/213
5,580,693 A * 12/1996 Nakajima et al. ..... 430/200
5,821,028 A * 10/1998 Maejima et al. ..... 430/201
6,027,850 A * 2/2000 Kawakami et al. ..... 430/201

FOREIGN PATENT DOCUMENTS

| | | |
|---|---|---|
| EP | 0576840 A2 | 1/1994 |
| EP | 0684145 A1 | 11/1995 |
| JP | 6-22080 | 1/1994 |
| JP | 6-1276851 | 5/1994 |
| JP | 8-197860 | 8/1996 |

* cited by examiner

*Primary Examiner*—Bruce H. Hess
(74) *Attorney, Agent, or Firm*—Finnegan, Henderson Farabow, Garrett & Dunner, L.L.P.

(57) ABSTRACT

A thermal transfer image forming material is disclosed, which comprises a intermediate layer, and an image forming layer onto a support. The thermal transfer image forming material comprises a matting material having a number average grain diameter greater than the average thickness of the intermediate cushion layer.

15 Claims, 1 Drawing Sheet

THERMAL TRANSFER IMAGE FORMING MATERIAL

FIELD OF THE INVENTION

The present invention relates to a thermal transfer image forming material in which an image is transferred to an image receiving material employing thermal transfer, and particularly to a thermal transfer image forming material, preferably employing a light-to-heat conversion-type heat mode recording method in which light is converted to heat, and thermal transfer is carried out employing generated heat. The present invention is related to a light-to-heat conversion-type heat mode recording material which is more preferably capable of producing highly detailed and/or full color images employing digital dry process.

BACKGROUND OF THE INVENTION

In light-to-heat conversion-type heat mode transfer, an image forming layer is transferred to an image receiving material from a recording material, and images are obtained by transferring the image forming layer to a final image recording material from the image receiving material. Therefore, close contact between the recording material and the image receiving material is extremely important. In particular, when an image is highly detailed, close contact depends greatly on the smoothness of the sheet of paper. Resolution in the range of a few to a dozen or so $\mu$m is required even for a color proof, which reproduces halftone dots and the unevenness of the surface of each sheet of paper cannot be ignored.

Japanese Patent Publication Open to Public Inspection No. 6-22080 discloses that as a means to enhance the close contact between a recording material and an image receiving material, a flexible or thermally softenable cushion layer is provided between the support and the image forming layer or the image receiving layer. In this case, the same patent publication describes a structure in which the recording material comprises at least a support, a cushion layer, a light-to-heat converting layer, and an image forming layer, and the image receiving material comprises at least a support, a cushion layer, a peeling layer, and an image receiving layer. In this technique, an image is formed in such a manner that the image forming layer, which is subjected to imagewise exposure during light irradiation, is peeled from the surface of the light-to-heat converting layer and the resulting image is then transferred to the image receiving layer of the image receiving material. The transferred image is laminated onto a final support employing the subsequent process, and the peeling layer as well as the image receiving layer is peeled from the surface to form a final image.

However, in these conventional examples, uneven density occasionally results in an image area during image formation, which has been noted as a problem.

Japanese Patent Publication Open to Public Inspection No. 6-127685 discloses a method in which a composition prepared by dissolving flexible elements in a solvent is applied onto a support to form a cushion layer, and before winding the resulting coating, an intermediate layer (a light-to-heat converting layer or a peeling layer) is adhered and a recording material or an image receiving material is prepared by applying an image forming layer or image receiving layer onto the resulting coating. However, in the above-mentioned method, during coating of the image forming layer or image receiving layer, the coating solvent penetrates into the cushion layer, and problems have occurred so that the storage stability of material itself is degraded due to the residual solvent, and the surface properties of the image forming layer as well as the image receiving layer tend to deteriorate.

Hence, the present inventors applied for Japanese Patent Application No. 7-8994 proposing the production method of a light-to-heat conversion-type heat mode recording image forming material in which transfer can be carried out so that the intermediate layer and the image forming layer are subjected to no peeling between layers and further, the releasing layer is utilized which results in no decrease in melt transfer sensitivity. However, this method resulted in another problem in which the production cost is raised due to the use of a temporary support.

When, without using said temporary support, a cushion layer, an intermediate layer, and an image forming layer are provided on a support employing a coating method in which each layer is successively applied thereon, unevenness results on the cushion layer due to flaws which are caused by the fact that the cushion layer, as the lower layer, is flexible during coating of the upper layer. The resulting unevenness adversely affects the performance of a light-to-heat converting agent and the like, and problems such as coating streaks, coating mottles, flaws due to conveyance rollers, and the like have occurred.

Further, in the above-mentioned coating method, after coating the cushion layer onto the support, the resulting coating is occasionally wound and stored in roll form until coating of an intermediate layer or an image forming layer. In such a state, another problem has occurred in which the cushion layer adheres to the reverse surface of the support due to the flexibility of the cushion layer itself, making it difficult after unwinding to coat an intermediate layer or an image forming layer during a coating process.

SUMMARY OF THE INVENTION

In view of the foregoing, the present invention has been accomplished. A first object of the present invention is to provide a light-to-heat conversion-type heat mode recording material which comprises a flexible cushion layer and exhibits excellent close contact with an image receiving material. A second object of the present invention is to provide a heat mode recording material which does not results in coating streaks, coating mottles, generation of flaws due to conveyance rollers, winding defects, and makes it possible to perform image transfer without a decrease in sensitivity. A third object of the present invention is to improve close contact, as well as to improve image defects due to tent during image formation and thereby uneven density within the transferred surface.

Another object is to provide a heat mode recording material which is simpler and more enabling cost reduction than those prepared by employing a conventional coating method in which a temporary support is used.

The above-cited objects of the present invention are accomplished by the thermal transfer image forming materials described below.

A thermal transfer image forming material of the invention comprises a support, an intermediate layer and an image forming layer containing a colorant and a binder, wherein a part of the image forming layer transfers by thermal transfer and the intermediate layer contains a matting material.

A number average particle diameter of the matting material is preferably greater than the thickness of the intermediate layer.

A part of the matting material contained in the intermediate layer is preferably projected from the outermost surface of a thermal transfer image forming material.

The intermediate layer preferably containing a matting material is a cushion layer.

The cushion layer contains preferably matting material of 100 to 3,000 particles/mm$^2$ and the difference between the number average particle diameter of the matting material and the thickness of the cushion layer is 1 to 5 $\mu$m.

The cushion layer contains preferably matting material of 300 to 2,000 particles/mm$^2$ and the difference between the number average particle diameter of the matting material and the thickness of the cushion layer is 1 to 3 $\mu$m.

The elastic modulus of the cushion layer is preferably not more than 250 kg/mm$^2$ at 25° C.

The custion layer preferably contains a binder and glass transition temperature (Tg) of the binder is not more than 80° C.

The penetration of the cushion layer is preferably at least 15 under the standard test conditions of JIS K2530-1976, an English translation of which is attached as an Appendix.

The thermal transfer image forming material comprises a cushion layer, and the intermediate layer containing the matting material is preferably a layer other than the cushion layer, preferably contains matting material of 100 to 3,000 particles/mm$^2$ and the difference between the number average particle diameter of the matting material and the thickness of the cushion layer is 0.2 to 4.5 $\mu$m.

The thermal transfer image forming material mentioned above in which the intermediate layer preferably contains matting material of 300 to 2,000 particles/mm$^2$ and the difference between the number average particle diameter of the matting material and the thickness of the cushion layer is 0.5 to 3 $\mu$m.

The thermal transfer image forming material mentioned above in which elastic modulus of the cushion layer is not more than 250 kg/mm$^2$ at 25° C.

The thermal transfer image forming material mentioned above in which, preferably, the cushion layer contains a binder and glass transition temperature (Tg) of the binder is not more than 80° C.

The thermal transfer image forming material mentioned above in which the penetration of the cushion layer is preferably at least 15 under the standard test conditions of JIS K2530-1976.

The thermal transfer image forming material mentioned above in which wherein $\sigma$/rn of the matting material is not more than 0.3; wherein $\sigma$ represents the standard deviation of the particle distribution of the matting material and rn represents number average particle diameter of the matting material.

The other embodiment of the invention is described.

A light-to-heat conversion-type heat mode recording material, which comprises successively a cushion layer and an image forming layer, in this order, provided on a support, wherein the cushion layer comprises a matting material having a number average particle diameter greater than the average thickness of the binder component of said cushion layer.

A light-to-heat conversion-type heat mode recording material which comprises a cushion layer, an intermediate layer, and an image forming layer provided on a support, wherein the intermediate layer comprises a matting material having a number average particle diameter greater than the average thickness of the binder component of said intermediate layer.

DETAILED DESCRIPTION OF THE INVENTION

In the production method of the thermal transfer image forming material, preferably light-to-heat conversion-type heat mode recording material employing multilayer coating, during coating of the upper layer onto the cushion layer, concerned has been the formation of coating streaks, coating mottles due to the cushion layer itself, flaws due to conveyance rollers, and the like. The present invention has overcome these concerns by employing a constitution in which the matting material having an average diameter greater than the thickness of said cushion layer is incorporated into said cushion layer as a means which enables carrying out the multilayer coating while maintaining the flexibility of the cushion layer, and further does not result in damage to the surface of the cushion layer. When an intermediate layer is provided between the cushion layer and the image forming layer, improvement has been carried out employing the constitution in which the matting material having an average particle diameter greater than the thickness of the intermediate layer was incorporated into the intermediate layer.

Preferably, various problems in conventional multilayer coating have been solved by controlling the amount of the above-mentioned matting material so as to obtain the appropriate volume and number of projections from the cushion layer, or from the intermediate layer, and further, improvements in coating properties as well as conveyance properties have been achieved while fully maintaining plate-making properties.

The invention is described in detailed.

1. Thermal Transfer Image Forming Material

The thermal transfer image forming material of the present invention is a material to transfer an image to an image receiving material utilizing thermal transfer through face to face contact of said thermal transfer image forming material with said image receiving material. Furthermore, the image receiving material is occasionally employed as an intermediate transfer material. In this case, an image transferred to the image receiving material from the thermal transfer image forming material is further transferred to a final image recording material from the image receiving material.

The thermal transfer image forming material of the present invention has such a structure that onto a support, an intermediate layer, and an image forming layer comprising colorants and binders are successively coated thereon. The intermediate layer may be composed of a single layer or a plurality of layers, and at least one intermediate layer comprises matting materials. Furthermore, the intermediate layer comprising a matting material is preferably adjacent to the image forming layer. Further, representative intermediate layers include a cushion layer, a light-to-heat converting layer, a peeling layer, an adhesive layer, and the like.

Figure 1:
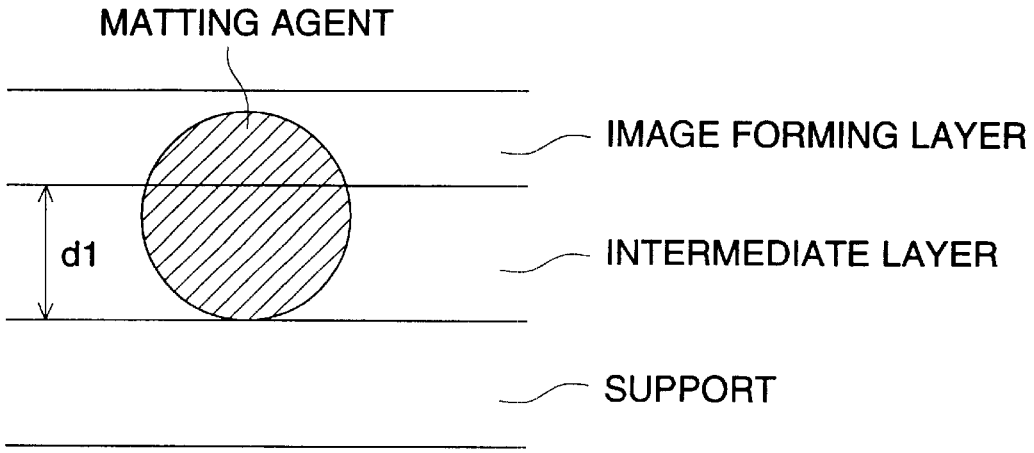
FIG. 1 is a sectional view of the image forming material of an example of the invention.
Figure 2:
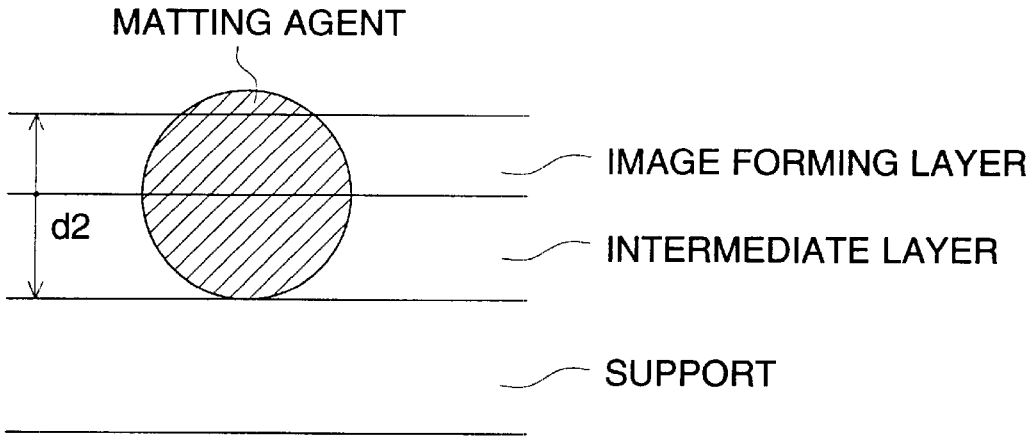
FIG. 2 is a sectional view of the image forming material of another example of the invention.

The number average particle diameter of the matting material is preferably greater than the thickness of the intermediate layer. "The number average particle diameter is greater than the thickness of the intermediate layer" is that as shown in FIG. 1, the number average particle diameter is greater than the thickness d1 of the matting material-free intermediate layer. Furthermore, at least one portion of the matting material incorporated into the intermediate layer is preferably projected from the outermost surface of a thermal transfer image forming material. As shown in FIG. 2, the number average particle diameter of the matting material is more preferably greater than the total thickness d2 of the intermediate layer and the image forming layer.

In FIGS. 1 and 2, both of the image forming layer and the intermediate layer seem to comprise matting material. In this specification the layer comprising matting material denotes the lowest layer among layers comprising the matting material, for example, the intermediate layer in the FIGS. 1 and 2. In case that the layers are formed by coating, the layer formed by coating composition containing the matting material is the layer comprising the matting material.

Further, the thermal transfer as described in the present invention is preferably thermal transfer employing a laser beam exposure. As the thermal transfer employing the laser beam exposure, a system is preferably employed in which employing the laser beam exposure, at least one whole portion of the image forming layer of a thermal transfer image forming material is transferred onto the image receiving material. For example, included are a laser ablation transfer system in which an image forming layer is transferred by ablation, a laser melt transfer system in which an image forming layer is melt-transferred, and the like.

In the present invention, particularly preferred as the thermal transfer image forming materials is a light-to-heat conversion-type heat mode recording material in which transfer is carried out employing heat generated by converting light to heat. Accordingly, in the following, the light-to-heat conversion-type heat mode recording material (hereinafter referred to as recording material) is primarily described.

Each element constituting the recording material is successively described below.

The recording material in the present invention comprises a support having thereon at least an intermediate layer and an image forming layer comprising a pigment. The intermediate layer may be comprised of a single layer or a plurality of layers, and at least one intermediate layer comprises a matting material. Further, a cushion layer is preferably provided as an intermediate layer.

Furthermore, when the image forming layer has no light-to-heat converting function, a light-to-heat converting layer is preferably provided as an intermediate layer adjacent to an image forming layer. In this case, the cushion layer may share the function of the light-to-heat converting layer. Other than the cushion layer, the light-to-heat converting layer may be provided. When the image forming layer has a light-to-heat converting function, the light-to-heat converting layer may not be provided as the intermediate layer. Further, a peeling layer and the like may be provided as other intermediate layers, and may share the functions of a light-to-heat converting layer, a cushion layer, and the like.

Furthermore, a back coat layer may be provided on the reverse surface of the image forming layer on a support.

The support may be any support, as long as it has excellent dimensional stability and heat resistance in forming an image. As the support is used, for example, a film or sheet disclosed on page 2, lower left column, lines 12 to 18 of Japanese Patent O.P.I. Publication No. 63-193886. The support has preferably stiffness or flexibility suitable for transport. The thickness of the support is preferably 25 to 200 $\mu$m, and more preferably 50 to 125 $\mu$m. An anti-static agent may be employed for preventing frictional electric charging. The anti-static agent includes a cationic, anionic or nonionic surfactant, a polymer anti-static agent, conductive fine particles and compounds described on pages 875 and 876 of "11290 Kagaku Shohin", Kagakukogyo Nipposha. Specific examples of preferred supports include PET (polyethylene terephthalate) film, PEN (polyethylene naphthalate) film, PP (polypropylene) film, polyimide film, paper laminated or coated with polyethylene or polypropylene, and the like.

An anti-static agent preferably used in the back coat includes conductive fine particles such as carbon black, metal oxides, for example, zinc oxide, titanium oxide, or tin oxide, and organic semiconductors. particularly, the conductive fine particles are free from separation from the layer and gives a stable anti-static effect independent of ambient atmosphere.

When an image is formed by exposing to a laser light from the recording material side, the support of the recording material is preferably transparent. When an image is formed by exposing to a laser light from the image receiving material side, the support of the recording material need not be transparent. The heat mode recording material is preferably thinner than the image receiving layer in view of easiness of superposing.

The image forming layer in the recording material comprises colorants as well as binders. Furthermore, when provided with a light-to-heat converting function, light-to-heat converting materials are incorporated. At least a portion of the image forming layer is transferred through ablation, or melt or softening while being heated. Further, when transferred through melt, transfer may be carried out without forming a perfectly melt state.

The colorant includes inorganic pigment (for example, titanium dioxide, carbon black, graphite, zinc oxide, Prussian blue, cadmium sulfate, iron oxide and a chromate of lead, zinc or barium), organic pigment (for example, azo compounds, indigo compounds, anthraquinone compounds, anthanthrone compounds, triphenedioxazine compounds, vat dye pigment, phthalocyanine pigment or its derivative, and quinacridone pigment) and dyes (for example, direct dyes, dispersion dyes, oil soluble dyes, metal-containing oil soluble dyes and sublimable dyes).

For example, as pigment for a color proof, C.I. 21095 or C.I. 21090 is used as a yellow pigment, C.I. 15850:1 as a magenta pigment, and C.I. 74160 as a cyan pigment.

The colorant content of the image forming layer may be adjusted in such a manner that an intended content can be obtained based on the intended coating thickness, and not specifically limited. The colorant content of the image forming layer is ordinarily 5 to 70% by weight, and preferably 10 to 60% by weight.

The binder of the image forming layer includes a heat fusible compound, a heat softening compound, and a thermoplastic resin. The heat fusible compound is a solid or semi-solid compound having a melting point of 40 to 150° C., the melting point measured by means of a melting point apparatus, Yanagimoto JP-2, and includes waxes, for example, vegetable wax such as carnauba wax, Japan wax, or esparto wax, animal wax such as bees wax, insect wax, shellac wax or spemaceti, petroleum wax such as paraffin wax, microcrystalline wax, polyethylene wax, ester wax or acid wax, and mineral wax such as montan wax, ozocerite or ceresine. The binder further includes a higher fatty acid such as palmitic acid, stearic acid, margaric acid or behenic acid, a higher alcohol such as palmityl alcohol, stearyl alcohol, behenyl alcohol, margaryl alcohol, myricyl alcohol or eicosanol, a higher fatty acid ester such as cetyl palmitate, myricyl palmitate, cetyl stearate or myricyl stearate, an amide such as acetoamide, propionic amide, stearic amide or amide wax, and a higher amine such as stearyl amine, behenylamine or palmityl amine.

The thermo plasticizer includes resins such as an ethylene copolymer, a polyamide resin, a polyester resin, a polyurethane resin, a polyoleffin resin, an acryl resin, a styreneacryl resin, a polyvinyl chloride resin, a polystyrene resin, polyvinylbutyral, a polyethylene resin, a cellulose resin, a rosin resin, a polyvinyl alcohol resin, a polyvinyl acetal resin, an ionomer resin or a petroleum resin; elastomers such as natural rubber, styrene-butadiene rubber, isoprene rubber, chloroprene rubber or a diene copolymer; rosin derivatives such as ester gum, a rosin-maleic acid resin, a rosin phenol resin or a hydrogenated rosin; a phenol resin, terpenes, a cyclopentadiene resin or aromatic hydrocarbon resins. Particularly resins having a melting point or softening point of 70 to 150° C. are preferably employed.

The thermal transfer layer having an intended softening or melting point can be obtained by suitably using the above described heat fusible compound or thermo plasticizer.

As disclosed in Japanese Patent O.P.I. Publication No. 62-108092, the uniforming the particle size of colorants can give high image density, but various additives can be used in order to secure colorant dispersion property or to obtain excellent color reproduction.

The other additives include a plasticizer for increasing sensitivity by plasticizing the image forming layer, a surfactant for improving coatability, and a matting material having a submicron to millimicron order particle size for minimizing blocking. Furthermore, fluorine based compounds and waxes may be incorporated into the image forming layer. Further, nonionic compounds such as polyethylene glycols, and the like are preferably incorporated into the image forming layer in an amount of at least 2 percent by weight of the same and preferably at least 5 percent by weight so as to increase sensitivity and to improve the reproduction of fine lines.

The thickness of the image forming layer is 0.2 to 2 $\mu$m, and preferably 0.3 to 1.5 $\mu$m. The thickness of not more than 0.8 $\mu$m gives high sensitivity, but the optimum thickness is selected according to balance between sensitivity and resolution or an intended image reproduction, since the transferability of the image forming layer is different from kinds of the binders used or their combination use ratio.

When a light-to-heat converting material is incorporated into the image forming layer, no light-to-heat converting layer is required as an intermediate layer. However, the light-to-heat converting material is not substantially transparent, considering the color reproduction of the transferred image, the light-to-heat converting material is not incorporated into the image forming layer, but a light-to-heat converting layer is preferably provided as an intermediate layer. Furthermore, a light-to-heat converting material is incorporated into a cushion layer functioning as an intermediate layer so that the cushion layer also works as the light-to-heat converting layer. The light-to-heat converting layer is preferably provided adjacent to the image forming layer.

The light-to-heat converting compound is preferably a compound which absorbs light and effectively converts to heat, although different due to a light source used. For example, when a semi-conductor laser is used as a light source, a compound having absorption in the near-infrared light region is used. The near-infrared light absorbent includes an inorganic compound such as carbon black, an organic compound such as a cyanine, polymethine, azulenium, squalenium, thiopyrylium, naphthoquinone or anthraquinone dye, and an inorganic metal complex of phthalocyanine, azo or thioamide type. Exemplarily, the near-infrared light absorbent includes compounds disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds can be used singly or in combination of two or more kinds thereof. Further, employed may be those in which the surface of carbon black is modified with a carboxyl group and sulfone group.

The intermediate layer incorporates binders. Furthermore, at least one intermediate layer incorporates matting materials. Specific examples of the intermediate layers include, as described above, a light-to-heat converting layer, a cushion layer, a peeling layer, an adhesive layer, and the like. Further, one layer may share a plurality of functions.

As the binder of the intermediate layer which works as the light-to-heat conversion layer, are used resins having high Tg and high heat conductivity. The binder includes resins such as polymethylmethacrylate, polycarbonate, polystyrene, ethylcellulose, nitrocellulose, polyvinylalcohol, polyvinyl chloride, polyamide, polyimide, polyetherimide, polysulfone, polyethersulfone, and aramide.

A water soluble polymer, colloidal silica and a polyamide acid can be also used as a binder in the intermediate layer which works as the light-to-heat conversion layer. The water soluble polymer is preferable because it gives excellent peelability between the image forming layer and the intermediate layer, has high heat resistance while irradiating light, restrains scatter or abrasion of the intermediate layer when excessive heat is applied. When the water soluble polymer is used, it is preferable that the light-to-heat converting compound is water soluble (by incorporation of a sulfo group to the compound) or dispersed in water. Furthermore, the light-to-heat converting layer may share the function of the peeling layer. In this case, various types of releasing agents are preferably incorporated into the light-to-heat converting layer. Naturally, when an independent intermediate layer as the peeling layer is provided, the releasing agent is preferably incorporated. By incorporating the releasing agent, the intermediate layer can give excellent peelability between the image forming layer and the intermediate layer and can improve sensitivity. The releasing agent includes a silicone releasing agent (for example, a polyoxyalkylene modified silicone oil or an alcohol modified silicone oil), a fluorine-containing surfactant (for example, a perfluoro phosphate surfactant, and other various surfactants.

The thickness of the light-to-heat converting layer which may also serve as the peeling layer is preferably 0.1 to 3 $\mu$m, and more preferably 0.2 to 1 $\mu$m. The light-to-heat converting compound content of the light-to-heat converting layer which may also serve as the peeling layer can ordinarily be determined in such a manner that the layer gives an optical density of preferably 0.3 to 3.0, more preferably 0.7 to 2.5 to light wavelength emitted from a light source used. When carbon black is used in the light-to-heat converting layer which may serve as the peeling layer and the layer thickness is more than 1 $\mu$m, scorching due to excessive heating does not occurs but sensitivity tends to be lowered. The layer thickness is optionally selected due to power of a laser used or the optical density of the light-to-heat converting layer which may serve as the peeling layer.

An adhesive layer may be provided between the support and the intermediate layer, for example, cushion layer or light-heat convert layer, to increase adhesive strength. An adhesive layer may be provided between the intermediate layers, for example, cushion layer and light-heat convert layer, to increase adhesive strength between these intermediate layers.

A conventional adhesive such as polyester, urethane or gelatin may be used in the adhesive layer. Further, in order to obtain the above effect, a cushion layer containing a tackifying agent or an adhesive may be provided instead of the adhesive layer.

The intermediate layer works as the cushion layer is provided for the purpose of increasing close adhesion of the resorting material to the intermediate transfer medium or the image receiving layer. The cushion layer is a layer having thermally softening property or thermoelasticity, which is formed by a material thermally deformable by applying heat, or a material having low elasticity or gum elasticity. Indexes to represent cushion properties include the elastic modulus as well as penetration. For example, it is confirmed that a layer having an elastic modulus of about 1 to about 250 kg/mm$^2$ or a layer having a penetration of about 15 to about 500 specified in JIS K2530-1976 exhibits cushion properties appropriate for forming color proof images for color proofing, and also primarily exhibits excellence in transfer sensitivity and foreign matter resistance. Furthermore, in light-to-heat conversion-type heat mode recording (hereinafter occasionally referred to as heat mode recording), as exposure time is shortened, energy loss due to heat conduction to the support from the image forming layer decreases. Compared to ordinary thermal transfer recording in which the image forming layer is heated through heat conduction from the support employing a thermal head, in the heat mode recording, heat energy applied to the part other than the image forming layer is small. Owing to that, the cushion layer is required to exhibit sufficient cushion properties employing heat energy generated in the image forming layer during exposure. In order to accomplish the decrease in elastic modulus or thermal softening with the use of such a minimal heat amount, Tg of resins forming the cushion layer is preferably no more than 80° C.

Specifically, the cushion layer is preferably comprised of components having thermoplasticity as a binder thereof. Such components include, for example, ethylene-vinyl acetate copolymers, ethylene-ethyl acrylate copolymers, polybutadiene resins, styrene-butadiene copolymers (SBR), styrene-ethylene-butene-styrene copolymers (SEBS), acrylonitrile-butadiene copolymers (NBR), polyisoprene resins (IR), styrene-isoprene (SIS), acrylic acid ester copolymers, polyester resins, polyurethane resins, acrylic resins, butyl rubber, polynorbornene, and the like.

In order to form the cushion layer onto a support, the above-mentioned component is dissolved in a solvent or is dispersed into a latex form, and the resulting is applied onto the support employing coating methods using a blade coater, a roll coater, a bar coater, a curtain coater, a gravure coater, and the like; a hot melt extrusion lamination method; and the like. The thickness of the cushion layer is preferably between 1 and 10 $\mu$m.

In the present invention, employed as matting materials which are preferably incorporated into the intermediate layer may be fine organic or inorganic particles. Organic series matting materials include polymethyl methacrylate (PMMA), polystyrene, polyethylene, polypropylene, other fine radical polymerization series polymer particles, fine condensation polymer particles such as polyester, polycarbonate and the like. As described above, the number average particle diameter of the matting material is preferably greater than the thickness of the interlayer. Further, at least one portion of the matting material incorporated into the interlayer is preferably projected from the outermost surface of a thermal transfer image forming material. The number average particle diameter is preferably greater than the total thickness of the interlayer and the image forming layer.

In case the intermediate layer containing the matting material is a cushion layer, it is prepared by applying a coating composition to which these matting materials are directly added. The number average particle diameter is preferably 1 to 5 $\mu$m greater than the thickness of the cushion layer, and in the range of 100 to 3,000 particles/mm$^2$ is preferably said matting material. Further, the number average particle diameter is preferably 1 to 3 $\mu$m greater than the average thickness of the layer comprised of the binder component itself, and in the range of 300 to 2,000 particles /mm$^2$ is preferably said matting material.

When the intermediate layer comprising the matting material is an intermediate layer other than the cushion layer, regarding the matting material incorporated into the interlayer, matting material is preferably 0.2 to 4.5 $\mu$m greater than the total thickness of the binder component of both the cushion layer and the intermediate layer, and in the range of 100 to 3,000 particles/mm$^2$ is preferably said matting material. Further, the number average particle diameter is preferably 0.5 to 3 $\mu$m greater than the total thickness of both the cushion layer and the intermediate layer, and in the range of 300 to 2,000 particles/mm$^2$ is preferably said matting material.

The matting material is preferably employed which has a narrow particle diameter distribution so that $\sigma$/rn (the variation coefficient of a particle diameter distribution) is no more than 0.3, wherein $\sigma$ is the standard deviation of the particle diameter distribution of the above-mentioned matting material and rn is the number average particle diameter. When such a matting material is employed, close contact with an image receiving material or an intermediate transfer medium is uniformly carried out to obtain enhanced stabilization due to an increase in sensitivity within the image area and effects of ablation and the like. Said variation coefficient is more preferably no more than 0.15. The layer thickness of the cushion layer other than matting material part is preferably between about 1 and about 10 $\mu$m.

The other intermediate layer comprises the matting material when the thermal transfer image forming material does not include the cushion layer.

2. Intermediate Transfer Medium As An Image Receiving Layer

As the intermediate transfer medium which is employed in combination with the recording material of the present invention, preferred is an intermediate transfer medium for a thin layer thermal transfer method capable of thermally transferring an image forming layer, which is employed as the intermediate transfer medium of a recording material which is employed for melt thermal transfer using a conventional thermal head or electric current running head.

The intermediate transfer medium is preferably constituted in such a manner that a back coat layer is applied onto one surface of a support and a cushion layer and an image receiving layer are successively applied to the other surface of the support. If desired, a peeling layer may suitably be formed between the cushion layer and the image receiving layer.

The support may be any support, as long as it has excellent dimensional stability and heat resistance in forming an image. As the support is used, for example, a film or sheet disclosed on page 2, lower left column, lines 12 to 18 of Japanese Patent O.P.I. Publication No. 63-193886. The support has preferably stiffness or flexibility suitable for transport. The thickness of the support is preferably 25 to 200 $\mu$m, and more preferably 50 to 125 $\mu$m.

An anti-static agent may be employed for preventing frictional electric charging. The anti-static agent includes a cationic, anionic or nonionic surfactant, a polymer anti-static agent, conductive fine particles and compounds described on pages 875 and 876 of "11290 Kagaku Shohin", Kagakukogyo Nipposha.

An anti-static agent preferably used in the back coat includes conductive fine particles such as carbon black, metal oxides, for example, zinc oxide, titanium oxide, or tin oxide, and organic semiconductors. Particularly, the conductive fine particles are free from separation from the layer and give a stable anti-static effect independent of ambient atmosphere.

The binder used in the back coat layer includes a polymer such as gelatin, polyvinyl alcohol, methylcellulose, nitrocellulose, acetylcellulose, an aromatic polyamide resin, a silicone resin, an epoxy resin, an alkyd resin, a phenol resin, a melamine resin, a fluorine-containing resin, a polyimide resin, a polyurethane resin, an acryl resin, a urethane modified silicone resin, a polyethylene resin, a polypropylene resin, a teflon resin, a polyvinyl butyral resin, a polyvinyl chloride resin, polyvinyl acetate, polycarbonate, an organic boron compound, an aromatic ester, a fluorinated polyurethane, polyether sulfone, polyester resin or polyamide resin.

The matting material preferably used in the back coat layer includes organic or inorganic fine particles. The organic matting material includes fine particles such as polymethyl methacrylate (PMMA), polystyrene, polyethylene, polypropylene or other radical polymerization polymers and polycondensation polymer fine particles such as polyesters and polycarbonates.

The coating weight of the back coat layer is preferably 0.5 to 3 g/m$^2$. The number average particle size of the matting material is preferably 5 $\mu$m or more larger than the thickness of the back coat layer containing only a binder resin. The back coat layer containing a matting material having a particle size of 8 mm or more in an amount of 5 mg/m$^2$ minimizes foreign matter problems.

The back coat layer preferably contains an anti-static agent in order to prevent foreign matter adherence due to frictional electrification caused during contact with a transport roller.

The back coat layer may contain various surfactants, silicone oil or a fluorine-containing resin in order to have a releasing or coating property.

The cushion layer is preferably composed of a material having thermal plasticity. Examples of the preferable resins include an ethylene-vinyl acetate copolymer, an ethylene-ethyl acrylate copolymer, a polybutadiene resin, a styrene-butadiene copolymer (SBR), a styrene-ethylene-butene-styrene copolymer (SBES), an acrylonitrile-butadiene copolymer (NBR), a polyisoprene copolymer (IR), a styrene-isoprene copolymer (SIS), an acrylate copolymer, a polyester resin, a polyurethane resin, an acryl resin, a butyl rubber and a polynorbornene.

The additives other than the described above can also give preferable properties to the cushion layer. These additives include a low melting point compound such as wax and a plasticizer such as phthalate, adipate, a glycol ester, a fatty acid ester, a phosphate, and chlorinated paraffin. Additives as described in "Purasuchikku oyobi gomuyo tenkazai jitsuyo binran (Practice Handbook of Additives to Plastic and Gum)", Kagaku Kogyosha (1970) can be used.

The addition amount of the additives may be an amount necessary to develop preferable properties with main components used in the cushion layer with no special limitations, but is preferably 10 weight %, more preferably 5 weight %, based on the total cushion layer weight.

The cushion layer is formed by the similar way as above mentioned "1. recording material".

The thickness of the cushion layer is preferably 10 $\mu$m or more, and more preferably 20 $\mu$m or more. When an image is re-transferred onto another image receiving material (for example, coat paper or wood-free paper), the thickness of the cushion layer is preferably 30 $\mu$m or more. The cushion layer thickness less than 10 $\mu$m results in transfer failure in re-transferring an image to the final image receiving layer.

The image receiving layer contains a binder resin and a matting material, and optionally various additives. The resin used in the image receiving layer includes an adhesive such as a polyvinyl acetate emulsion type adhesive, a chloroprene emulsion type adhesive or an epoxy resin type adhesive, a tackifying agent such as a natural rubber, chloroprene rubber, butyl rubber, polyacrylate, nitrile rubber, polysulfide, silicone rubber or a petroleum resin, a reclaimed rubber, a vinylchloride resin, SBR, polybutadiene resin, polyisoprene, a polyvinyl butyral resin, polyvinyl ether, an ionomer resin, SIS, SEBS, an acryl resin, an ethylene-vinyl chloride copolymer, an ethylene-acryl copolymer, an ethylene-vinyl acetate resin (EVA), a vinyl chloride grafted EVA resin, an EVA grafted vinyl chloride resin, a vinyl chloride resin, various modified olefins and polyvinyl butyral. The binder thickness of the image receiving layer is preferably 0.8 to 2.5 $\mu$m.

The image receiving layer is preferably construction having projections so as to have adequate closely contact under reduced pressure, for example, the layer preferably contains a matting material. The volume average particle size of the matting material is preferably 2 to 5 $\mu$m larger than the average thickness of the layer in the absence of the matting material, and the matting material content of the image receiving layer is preferably 0.02 to 0.2 g/m$^2$. In case of less than 2 $\mu$m satisfactory close contact under reduced pressure is hard to obtain, and not more than 5 $\mu$m contact with the recording material is deteriorated. This content of the matting material is preferable in keeping moderate adherence in a thin layer heat fusion transfer recording method comprising transfer recording of a thin layer image forming layer and particularly a heat mode transfer recording method.

It is preferable that the matting material the number average particle size of which is 2 to 4 $\mu$m larger than the average thickness of the image receiving layer in the absence of the matting material is contained in the image receiving layer in an amount of 70% or more.

The binder of the releasing layer includes polyester, polyvinyl acetal, polyvinyl formal, polyparabanic acid, polymethylmethacrylate, polycarbonate, ethylcellulose, nitrocellulose, methylcellulose, carboxymethylcellulose, hydroxypropylcellulose, polyvinyl alcohol, polyvinyl chloride, polystyrene, acrylonitrile styrene or their cross-linked polymers, a heat hardenable resin having a Tg of 65° C. or more such as polyamide, polyimide, polyetherimide, polysulfone, polyethersulfone or aramide or their hardened resin. The cross-linking agent includes a conventional one such as isocyanate or melamine.

The binder of the releasing layer is preferably polycarbonate, acetal, or ethylcellulose in view of storage stability, and it is more preferable that when an acryl resin is used in the image receiving layer, releasing is excellent in re-transferring an image transferred after a laser heat transfer method.

A layer whose adhesiveness to the image receiving layer is poor in cooling can be used as a releasing layer. Such a layer is, for example, a layer containing a heat fusible compound such as waxes or a thermoplasticizer.

The heat fusible compound includes compounds disclosed in Japanese Patent O.P.I. Publication No. 63-193886, and microcrystalline wax, paraffin wax or carnauva wax is preferably used. As the thermoplasticizer, an ethylene copolymer such as ethylene-vinyl acetate copolymer or a cellulose resin is preferably used.

As an additive, a higher fatty acid, a higher alcohol, a higher fatty acid ester, an amide or a higher amine is optionally added to the releasing layer.

Another releasing layer is a layer which is melted or softened while heating, resulting in cohesive failure and is released.

Such a layer preferably contains a supercooling agent. The supercooling agent includes poly-e-caprolactam, polyoxyethylene, benzotriazole, tribenzylamine and vanillin.

Still another releasing layer may contain a compound lowering adhesiveness to the image receiving layer. The compound includes a silicone resin such as silicone oil, a fluorine-containing resin such as teflon or a fluorine-containing acryl resin or a polysiloxane resin, an acetal resin such as polyvinyl butyral, polyvinyl acetal, polyvinyl formal, solid wax such as polyethylene wax or amide wax, a fluorine-containing surfactant and a phosphate surfactant.

The releasing layer is formed by dissolving or dispersing the compounds described above in a solvent and coating the resulting solution or dispersion on the cushion layer by means of a blade coater, a roller coater, a bar coater, a curtain coater or a gravure coater, or by hot-melt extrusion laminating. Further, the releasing layer can be formed by coating the resulting solution or dispersion on a temporary support, laminating the coated on the cushion layer, and then peeling the temporary support.

The thickness of the releasing layer is preferably 0.3 to 3.0 $\mu$m. When the releasing layer is too thick, property of the cushion layer is difficult to develop, and the thickness need be adjusted according to kinds of the releasing layer.

The description as above can be applied to not only an intermediate transfer medium but an image receiving material, on which an image is formed and the image is employed as a final image.

EXAMPLES

The invention will be explained by the following examples. In the examples, "parts" is parts by weight, unless otherwise specified.

Example 1

<Preparation of an Image Receiving Material>

After coating the back coat layer coating composition described below onto 100 $\mu$m thick PET base as a support, the resulting coating was dried at 100° C. for one minute in a thermostat. The dried coated amount was about 2.3 g/m$^2$.

| (Back Coat Layer Coating Composition) | |
|---|---|
| MHI Black #273 (18 weight % dispersion of carbon black in MEK, manufactured by Mikuni Shikiso Co., Ltd.) | 4.9 parts |
| MX-1000 (Makusoru Matting Material, aqueous dispersion with an average grain diameter of 10 $\mu$m, manufactured by Soken Kagaku Co., Ltd.) | 2.1 parts |
| X24-8300 (dissolved silicone resin, manufactured by Shin-Etsu Kagaku Co., Ltd. | 1.4 parts |
| 30 weight % of Pairon 200 (polyester resin, manufactured by Toyobo) dissolved in MEK | 19.5 parts |

-continued

| (Back Coat Layer Coating Composition) | |
|---|---|
| MEK | 4.4 parts |
| Toluene | 12.6 parts |
| Anone | 25.2 parts |

Thereafter, onto the opposite surface of the back coat layer of the support, the cushion coating composition described below was applied employing an applicator and dried to obtain a 30 $\mu$m thick cushion layer.

(Cushion Layer Coating Composition)

Acryl based latex (Yodosol AD92K, manufactured by Kanebo NSC Co.) 100 parts

Subsequently, onto the above-mentioned cushion layer, the peeling layer coating composition described below was coated employing a wire bar method and dried to obtain a 1.8 $\mu$m thick peeling layer.

| (Peeling Layer Coating Composition) | |
|---|---|
| Ethyl cellulose (Etocel 10, manufactured by Dow Chemical Co.) | 10 parts |
| Isopropyl alcohol | 90 parts |

Subsequently, onto the peeling layer, the image receiving layer composition described below was coated employing a wire bar method and dried to form an image receiving layer having a coated amount of 1.5 g/m$^2$.

| (Image Receiving Layer Coating Composition) | |
|---|---|
| Polyacrylic acid latex (Yodosol A5805, 55% solid portion, manufactured by Kanebo NSC Co.) | 25 parts |
| Matting material dispersion (MX-40S, 30% solid portion, manufactured by Soken Kagaku Co.) | 1.8 parts |
| Fluorine based resin (Sumiraze Resin FP-150, 15% solid portion manufactured by Sumitomo Kagaku Co.) | 4.2 parts |
| Isopropyl alcohol | 9 parts |
| Deionized water | 60 parts |

<Preparation of a Thermal Transfer Image Forming Material>

In the same manner as the image receiving layer, onto the surface opposite to the back coat layer of the support which had been subjected to coating up to the back coat layer, the cushion layer coating composition described below was coated employing a wire bar and dried to obtain a 1.8 $\mu$m thick cushion layer.

| (Cushion Layer Coating Composition) | |
|---|---|
| Styrene-ethylene-butadiene-styrene resin (Clayton G1657, manufactured by Shell Kagaku Co.) | 10 parts |
| Tackyfier | 4.5 parts |
| Methyl ethyl ketone | 17 parts |
| Toluene | 68 parts |
| Silicone resin particles (T-130, average particle diameter of 3.0 $\mu$m, manufactured by Toshiba Silicone Co.) | 0.04 parts |

Subsequently, onto the cushion layer, the light-to-heat converting layer coating composition described below was coated employing wire bar and dried to obtain a 0.5 μm thick light-to-heat converting layer.

| (Light-to-heat converting layer Coating Composition) | |
|---|---|
| 10 weight % aqueous polyvinyl alcohol solution (Gosenol EG-30, manufactured by Nihon Goseishi Kagaku Co.) | 10.5 parts |
| Carbon black dispersion (30% solid portion, SD-9020, manufactured by Dianippon Ink Co.) | 4.4 parts |
| Water | 68 parts |
| i-Propyl alcohol | 17 parts |

Subsequently, onto the light-to-heat converting layer, the image forming layer coating composition described below was coated employing a wire bar and dried to obtain a 0.1 μm thick image forming layer.

| (Image forming layer Coating Composition) | |
|---|---|
| Magenta pigment dispersion (MHI Magenta 1038, 10 weight % of pigment solid portion, average particle diameter of 0.16 μm, manufactured by Mikuni Shikiso Co.) | 12 parts |
| Styrene/acrylic resin (Himer SBM73F, manufactured by Sanyo Kasei Co.) | 2.4 parts |
| Ethylene/vinyl acetate resin (Everflex EV40Y, manufactured by Mitsui Du Pont Polychemical) | 0.2 part |
| Fluorine based surface active agent (Surfron S-382), manufactured by Asahi Glass) | 0.1 part |
| Methyl ethyl ketone (MEK) | 60.5 parts |
| Cyclohexanone | 24.8 parts |

Example 2

A thermal transfer image forming material was prepared in the same manner as Example 1, except that the matting material in the cushion layer coating composition was replaced with the one described below.

| | |
|---|---|
| Crosslinking PMMA particles (MP-1400, average particle diameter of 3.0 μm, manufactured by Soken Kagaku Co.) | 0.09 part |

Example 3

A thermal transfer image forming material was prepared in the same manner as Example 1, except that a matting material in the cushion layer coating composition was replaced with the one described below.

| | |
|---|---|
| Silicone resin particles (T-145, an average particle diameter of 5.0 μm, manufactured by Toshiba Silicone Co.) | 0.56 part |

Example 4

In the same manner as the image receiving layer, onto the reverse surface of the back coat layer of the support which had been subjected to coating up to the back coat layer, the cushion layer coating composition described below was coated employing a wire bar and dried to obtain a 1.8 μm thick cushion layer.

| (Cushion Layer Coating Composition) | |
|---|---|
| Styrene ethylene-butadiene-styrene resin (Clayton G1657, manufactured by Shell Kagaku Co.) | 10 parts |
| Tackyfier | 4.5 parts |
| Methyl ethyl ketone | 17 parts |
| Toluene | 68 parts |

Subsequently, onto the cushion layer, the light-to-heat converting layer coating composition described below was coated employing wire bar and dried to obtain a 0.5 μm thick light-to-heat converting layer.

| (Light-to-heat converting layer Coating Composition) | |
|---|---|
| 10 weight % aqueous polyvinyl alcohol solution (Gosenol EG-30, manufactured by Nihon Goseishi Kagaku Co.) | 10.5 parts |
| Carbon black dispersion (30% solid portion, SD-9020, manufactured by Dianippon Ink Co.) | 4.4 parts |
| Water | 68 parts |
| i-Propyl alcohol | 17 parts |
| Silicone resin particles (T-145, average particle diameter of 4.5 μm, manufactured by Toshiba Silicone Co.) | 0.56 part |

Subsequently, onto the light-to-heat converting layer, the image forming layer coating composition described below was coated employing a wire bar and dried to obtain a 0.1 μm thick image forming layer.

| (Image forming layer Coating Composition) | |
|---|---|
| Magenta pigment dispersion (MHI Magenta #1038, 10 weight % of pigment solid portion, average particle diameter of 0.16 μm, manufactured by Mikuni Shikiso Co.) | 12 parts |
| Styrene/acrylic resin (Himer SBM73F, manufactured by Sanyo Kasei Co.) | 2.4 parts |
| Ethylene/vinyl acetate resin (Everflex EV40Y, manufactured by Mitsui Du Pont Polychemical) | 0.2 part |
| Fluorine based surface active agent (Surfron S-382), manufactured by Asahi Glass) | 0.1 part |
| Methyl ethyl ketone (MEK) | 60.5 parts |
| Cyclohexanone | 24.8 parts |

Example 5

A thermal transfer image forming material was prepared in the same manner as Example 4, except that the matting material in the light-to-heat converting layer coating composition was replaced with the one described below.

| | |
|---|---|
| Silicone resin particles (T-145, average particle diameter of 4.5 μm, manufactured by Toshiba Silicone Co.) | 0.75 part |

Example 6

A thermal transfer image forming material was prepared in the same manner as Example 4, except that the matting material in the light-to-heat converting layer coating composition was replaced with the one described below.

| | |
|---|---|
| Crosslinking PMMA particles (MX-500, average particle diameter of 5.0 μm, manufactured by Soken Kagaku Co.) | 1.88 parts |

Example 7

A thermal transfer image forming material was prepared in the same manner as Example 4, except that the thickness of the cushion layer was varied to 1.0 μm and the matting material in the light-to-heat converting layer coating composition was replaced with the one described below.

| | |
|---|---|
| Crosslinking PMMA particles (MX-500, average particle diameter of 5.0 μm, manufactured by Soken Kagaku Co.) | 1.88 parts |

Example 8

A thermal transfer image forming material was prepared in the same manner as Example 1, except that the matting material was replaced with the one described below.

| | |
|---|---|
| Silicone resin particles (T-145, average particle diameter of 4.5 μm, manufactured by Toshiba Silicone Co.) | 0.02 part |

Example 9

A thermal transfer image forming material was prepared in the same manner as Example 1, except that the matting material was replaced with the one described below.

| | |
|---|---|
| Silicone resin particles (Tospearl 3120, average particle diameter of 12 μm, manufactured by Toshiba Silicone Co.) | 0.02 part |

Table 1 below shows details of thermal transfer image forming materials obtained in Examples 1 through 9. The layer thickness in Table 1 is the thickness of layers formed by layer coating compositions into which matting materials are incorporated.

TABLE 1

| Example | Particle Diameter of Matting material μm | Protection from Layer μm | Layer thickness μm | Number of Particles/ $mm^2$ |
|---|---|---|---|---|
| 1 | 3 | 1.2 | 1.8 | 500 |
| 2 | 3 | 1.2 | 1.8 | 1000 |
| 3 | 5 | 3.2 | 1.8 | 1500 |
| 4 | 4.5 | 4 | 0.5 | 500 |
| 5 | 4.5 | 4 | 0.5 | 700 |
| 6 | 5 | 4.5 | 0.5 | 1500 |
| 7 | 5 | 4.5 | 0.5 | 1500 |
| 8 | 4.5 | 2.7 | 1.8 | 100 |
| 9 | 12 | 10.2 | 1.8 | 10 |

Obtained thermal transfer image forming materials were subjected to image formation employing laser thermal transfer described below.

(Image Formation Employing Laser Thermal Transfer)

For an optical system in which employing a semiconductor laser beam having a wavelength of 830 nm, the spot diameter of $1/e^2$ set at 8 μm; a recording sheet and an image receiving material which were brought into close contact with a drum-shaped pressure reducing unit under a reduced pressure of 400 torr were rotated at a line speed of 600 cm/second; at an exposure pitch of 6 μm, were subjected to exposure of which power on the exposed surface was variable from 30 to 100 mW, and were then subjected to transfer.

<Evaluation>

Each property was evaluated based on the evaluation method described below.

(Conveying Properties)

During exposure to a thermal transfer image forming material set in an output unit, flaws caused during conveying of a sheet (conveyance flaw) were observed.

A: no flaws were observed

B: flaws were occasionally observed

C: flaws were steadily observed (Bar Abrasion)

When the thermal transfer image forming material was prepared by employing a wire bar coating method, evaluated was the generation frequency of abrasion on the thermal transfer image forming material, due to the lower layer scratched by the bar.

A: no abrasion due to the bar was observed

B: abrasion due to the bar was occasionally observed

C: abrasion was steadily observed (Winding Properties)

When a thermal transfer image forming material was unwound, which had been subjected to coating of a cushion layer coating composition employing a wire bar coating method and had been temporarily wound, unwinding problems due to blocking were evaluated.

A: unwinding was trouble-free

B: unwinding was possible but was not stable

C: unwinding was unfeasible (Sensitivity)

For an optical system in which, employing a semiconductor laser beam having a wavelength of 830 nm, the spot diameter of $1/e^2$ was set at 8 μm; a recording sheet and an image receiving material which were brought into close contact with a drum-shaped pressure reducing unit under a reduced pressure of 400 torr were rotated at a line speed of 600 cm/second; at an exposure pitch of 6 μm, were subjected to exposure of which the power on the exposed surface was variable from 30 to 100 mW, and were then subjected to transfer. The density of the resulting solid image was measured and the power at which the density was constant was obtained. The transfer properties at the obtained power were evaluated based on the following criteria:

AA: both the longitudinal lines and lateral lines in 4000 dpi were transferred

A: longitudinal lines in 4000 dpi were transferred

B: longitudinal lines in 4000 dpi were not transferred

C: longitudinal lines in 2000 dpi were not transferred (Uniformity of Dot Gain within the Image Area)

The sheet was exposed to 5% and 50% dot patterns, and the dot gain value (DG) of the resulting transferred image was measured by an optical reflection sensitometer (D-186, manufactured by Gretag Co.). The stability of the obtained value was evaluated based on the following criteria:

A: DG value moved within 1

B: DG value moved in the range of 1 to 5

C: DG value moved in the range beyond 5

(Defects due to Insufficient Air Removal)

Defects due to insufficient contact between the image receiving material and the thermal transfer image forming material, caused by insufficient air removal were evaluated based on the following criteria:

A: defects of no more than 1 mm were observed, but they did not adversely affect the appearance of the images B: defect of 1 to 5 mm were observed C: defect exceeding 5 mm were observed (Foreign Matter Resistance)

About 20 $\mu$m×5 mm of string, serving as a foreign, matter was placed between a thermal transfer image forming material and an image receiving material, and the effect of said string on transfer was visually observed.

A: the image 1 mm from the edges of the string was transferred

B: the image 2 to 3 mm from the edges of the string was transferred

C: the image at least 5 mm from the edges of the string was transferred

Table 2 shows the obtained results.

TABLE 2

| | | Coatability | | | Transferability | | |
|---|---|---|---|---|---|---|---|
| Example | Conveying Properties | Bar Abrasion | Winding Properties | Sensitivity | DG Uniformity within Surface | Defects due to Air Removal | Foreign Matter Resistance |
| 1 | B | B | A | A | A | A | A |
| 2 | B | B | A | A | A | A | A |
| 3 | A | A | A | A | A | A | A |
| 4 | A | A | A | A | A | A | A |
| 5 | A | A | A | A | A | A | A |
| 6 | A | A | A | A | A | A | A |
| 7 | A | A | A | A | A | A | A |
| 8 | A | A | A | A | A | A | A |
| 9 | A | A | A | B | A | A | A |

As can clearly be seen from Table 2, Example 3 exhibits markedly excellent evaluation results for each item, which comprises a matting material having a number average particle diameter greater than the average thickness of the binder of the cushion layer, and exhibits the number of matting material particles in the specified range, and the difference between the thickness of the cushion layer and the particle diameter in the optimum range. It is found that Example 3 is collectively improved under appropriate balance. In addition, it is found that Examples 4, 5, 6, and 7, which comprise a matting material having a number average particle diameter greater than the average thickness of the binder of the light-to-heat converting layer, and exhibits the number of matting material particles in the specified range, and the difference between the thickness of the cushion layer and the particle diameter in the optimum range, exhibit markedly excellent effects for each evaluation item, and are collectively improved under appropriate balance.

The present invention can accomplish objects to solve various problems in multilayer coating by incorporating a matting material into an intermediate layer such as a cushion layer, a light-to-heat converting layer, and the like, and further to provide an excellent thermal transfer image forming material, preferably a light-to-heat conversion-type heat mode recording material, which does not adversely affect plate making properties.

The present invention can provide a thermal transfer image forming material which comprises a flexible cushion layer and exhibits excellent close contact with an image receiving layer. In particular, by enhancing the close contact between an image receiving material and a thermal transfer image forming material, image defects due to insufficient air removal during image formation and uneven density in the transfer surface can be improved. As a result, dot gain within the image area is stabilized. Furthermore, coating streaks, coating mottles, flaws due to transport rollers, and the like are not caused and still further winding defects are not generated. Furthermore, it is possible to provide a thermal transfer image forming material in which image transfer is carried out without a decrease in sensitivity.

What is claimed is:

1. A thermal transfer image forming material comprising a support, an intermediate layer and an image forming layer containing a colorant and a binder, wherein a part of the image forming layer and the intermediate layer contain a matting material, wherein a number average particle diameter of the matting material is greater than the thickness of the intermediate layer, and wherein a particle of the matting material extends from the intermediate layer into the image forming layer.

2. The thermal transfer image forming material of claim 1 wherein a part of the matting material contained in the intermediate layer is projected from the outermost surface of the thermal transfer image forming material.

3. The thermal transfer image forming material of claim 1 wherein the intermediate layer containing the matting material is a cushion layer.

4. The thermal transfer image forming material of claim 3, wherein the cushion layer contains matting material of 100 to 3,000 particles/mm$^2$ and the number average particle diameter of the matting material is 1 to 5 $\mu$m greater than the thickness of the cushion layer.

5. The thermal transfer image forming material of claim 4, wherein the cushion layer contains matting material of 300 to 2,000 particles/mm$^2$ and the number average particle diameter of the matting material is 1 to 3 $\mu$m greater than the thickness of the cushion layer.

6. The thermal transfer image forming material of claim 3 wherein elastic modulus of the cushion layer is not more than 250 kg/mm$^2$ at 25° C.

7. The thermal transfer image forming material of claim 3 wherein the cushion layer contains a binder and glass transition temperature (Tg) of the binder is not more than 80° C.

8. The thermal transfer image forming material of claim 3 wherein penetration of the cushion layer is at least 15 under the standard test conditions of JIS K2530-1976.

9. The thermal transfer image forming material of claim 1 wherein the thermal transfer image forming material comprises a cushion layer and the intermediate layer containing the mating material is a layer other than the cushion layer.

10. The thermal transfer image forming material of claim 9 wherein elastic modulus of the intermediate layer is not more than 250 kg/mm$^2$ at 25° C.

11. The thermal transfer image forming material of claim 9 wherein the cushion layer contains a binder and glass transition temperature (Tg) of the binder is not more than 80° C.

12. The thermal transfer image forming material of claim 9 wherein penetration of the cushion layer is at least 15 under the standard test conditions of JIS K2530-1976.

13. The thermal transfer image forming material of claim 1, wherein the intermediate layer contains the matting material of 100 to 3,000 particles/mm$^2$ and the number average particle diameter of the matting material is 0.2 to 4.5 $\mu$m greater than the thickness of the intermediate layer.

14. The thermal transfer image forming material of claim 13, wherein the intermediate layer contains the matting material of 300 to 2,000 particles/mm$^2$ and the number average particle diameter of the matting material is 0.5 to 3 $\mu$m greater than the thickness of the intermediate layer.

15. The thermal transfer image forming material of claim 1 wherein $\sigma$/rn of the matting material is not more than 0.3; wherein $\sigma$ represents the standard deviation of the particle distribution of the matting material and rn represents number average particle diameter of the matting material.

* * * * *